US008540532B2

(12) United States Patent
Barnard et al.

(10) Patent No.: US 8,540,532 B2
(45) Date of Patent: Sep. 24, 2013

(54) ELECTRICAL CONTACT FOR SHOCK-RESISTANT ELECTRICAL CONNECTOR

(75) Inventors: Robert Barnard, Cleveland, TX (US); Michael Williams, Cypress, TX (US)

(73) Assignee: AG Geophysical Products, Inc., Cypress, TX (US)

( * ) Notice: Subject to any disclaimer, the term of this patent is extended or adjusted under 35 U.S.C. 154(b) by 0 days.

(21) Appl. No.: 13/564,865

(22) Filed: Aug. 2, 2012

(65) Prior Publication Data

US 2012/0295480 A1 Nov. 22, 2012

Related U.S. Application Data

(63) Continuation of application No. PCT/US2011/024085, filed on Feb. 8, 2011, which is a continuation of application No. 12/658,849, filed on Feb. 16, 2010, now abandoned.

(51) Int. Cl.
*H01R 13/648* (2006.01)

(52) U.S. Cl.
USPC ..... 439/607.01

(58) Field of Classification Search
USPC ..... 439/839, 752, 595, 852, 347, 587–589
See application file for complete search history.

(56) References Cited

U.S. PATENT DOCUMENTS

| | | | | |
|---|---|---|---|---|
| 4,550,972 | A * | 11/1985 | Romak | 439/839 |
| 5,591,051 | A * | 1/1997 | Ittah | 439/752 |
| 5,938,486 | A * | 8/1999 | Durand-Cochet et al. | 439/839 |
| 6,402,571 | B1 | 6/2002 | Muller et al. | |
| 6,447,319 | B1 | 9/2002 | Bodin | |
| 7,318,758 | B2 * | 1/2008 | Haller | 439/843 |
| 7,837,519 | B2 * | 11/2010 | Copper et al. | 439/839 |
| 7,942,683 | B2 * | 5/2011 | Copper et al. | 439/187 |
| 2008/0242151 | A1 | 10/2008 | Chiu | |

FOREIGN PATENT DOCUMENTS

| | | |
|---|---|---|
| DE | 19935793 | 2/2000 |
| DE | 10235058 | 2/2004 |

OTHER PUBLICATIONS

International Search Report and Written Opinion issued in PCT/US2011/024085, Apr. 6, 2011, 14 pages.
Written Opinion of the IPEA issued in PCT/US2011/024085, Jul. 11, 2011, 6 pages.
International Preliminary Report on Patentability issued in PCT/US2011/024085, Apr. 13, 2012, 8 pages.

* cited by examiner

*Primary Examiner* — Jean F Duverne
(74) *Attorney, Agent, or Firm* — Fish & Richardson P.C.

(57) ABSTRACT

An electrical connector in the form of a socket assembly defining a plurality of arcuate leaf contacts adapted for insertion of a pin contact therein. The socket assembly comprises an elongate socket core having the leaf contacts formed at a distal end thereof, and a substantially cylindrical hood surrounding the leaf contacts. In one embodiment of the invention, the hood is provided with structure for limiting the radial outward deflection of the leaf contacts when the electrical connector is subjected to shock forces. The limiting structure can be a stepped inner cylindrical sidewall of the hood, defining a reduced inner diameter portion of the hood surrounding at least a distal portion of each leaf contact.

19 Claims, 10 Drawing Sheets

ELECTRICAL CONTACT FOR SHOCK-RESISTANT ELECTRICAL CONNECTOR

CROSS-REFERENCE TO RELATED APPLICATIONS

The present application is a continuation of and claims priority to International Application No. PCT/US2011/024085 filed Feb. 8, 2011 entitled "ELECTRICAL CONTACT FOR SHOCK-RESISTANT ELECTRICAL CONNECTOR," which is an international application of and claims priority to U.S. patent application Ser. No. 12/658,849 entitled "ELECTRICAL CONTACT FOR SHOCK-RESISTANT ELECTRICAL CONNECTOR," filed Feb. 16, 2010.

FIELD

The present application relates generally to electrical connectors, and more particularly relates to shock-resistant electrical connectors.

BACKGROUND

Electrical connectors come in countless sizes, shapes and types. A common type of connector is a pin-and-socket connector in which a elongate pin contact (male) is received in a substantially hollow cylindrical socket contact (female) comprised of a plurality of arcuate leaf contacts. The leaf contacts abut the sidewalls of the pin contact providing electrical continuity.

There are numerous applications in which electrical connectors are used in environments in which the connectors are subjected to shock and vibration, often along multiple axes of force. One example of this is where cables are used to establish electrical connections between components of a sub-sea seismic measurement system including high-pressure explosive seismic sources and one or more hydrophones and other instruments for taking seismic readings in connection with oil and gas exploration. Electrical signals including timing and control signals, measurement signals, and so on, must be reliably conducted between the various components of the seismic system. These signals may be analog, digital, or a combination of the two.

Seismic sources generate tremendous shock waves, making it critical for any electrical connections in their vicinity to be robust and durable. Particularly where digital signals are involved (as is becoming more prevalent with state-of-the-art seismic instrumentation), it is important for electrical connections to be shock- and vibration-resistant, i.e., to maintain uninterrupted continuity over long periods of time even when subjected to mechanical forces (shock and vibration, or g-force) exerted on multiple axes.

It has been found in the prior art that there is a potential failure mechanism which can arise where conventional pin-and-socket connectors are subjected to repeated shocks or mechanical disturbances, such as from a seismic source. In particular, it has been found that in certain circumstances, the continuity between the pin contact and the leaf contacts that surround it can be interrupted for short periods of time (microseconds) in response to sufficiently energetic shocks produced by a seismic source.

Especially where digital signals are involved, and depending upon the fault tolerance of the digital circuitry involved, even such short interruptions in continuity can result in improper operation of the seismic equipment, loss of seismic data, and other problems. Modern day source controllers utilize continuous data streams which do not tolerate short-term connection interruptions caused by extreme g-force conditions.

This problem of electrical discontinuity can appreciably worsen when mechanical disturbances, either during use or during insertion or removal cause outward radial deflection of electrical contact components (e.g., leaf contacts) beyond a certain threshold, causing permanent deformation of the electrical contacts such that spring tension between the leaf contacts and an engaged pin contact is compromised.

SUMMARY

In view of the foregoing and other considerations, the present disclosure is directed to an electrical contact for use in a connector which is resistant to shock. As used herein, the descriptor "resistant to shock" or "shock-resistant" will be understood to mean that an electrical connector is capable of withstanding repeated and forceful mechanical disturbances without its contacts being stressed or deflected to such an extent that the connector fails to consistently maintain electrical continuity.

In accordance with one aspect of the invention, a socket assembly for a pin-and-socket type connector is modified relative to prior art designs. In particular, in one embodiment, a sleeve or hood element surrounding the leaf contacts of a socket body core is provided with structure which serves to limit the extent of outward deflection of the leaf contacts compared with prior art designs. In one embodiment the structure comprises a non-uniform stepped inner sidewall profile of the hood element which prevents the leaf contacts from deflecting to the point of yielding to a permanent extent.

BRIEF DESCRIPTION OF THE DRAWINGS

The present invention is best understood with reference to the following detailed description of embodiments of the invention when read in conjunction with the attached drawings, in which like numerals refer to like elements, and in which.

DETAILED DESCRIPTION

In the disclosure that follows, in the interest of clarity, not all features of actual implementations are described. It will of course be appreciated that in the development of any such actual implementation, as in any such project, numerous engineering and technical decisions must be made to achieve the developers' specific goals and subgoals (e.g., compliance with system and technical constraints), which will vary from one implementation to another. Moreover, attention will necessarily be paid to proper engineering practices for the environment in question. It will be appreciated that such development efforts might be complex and time-consuming, outside the knowledge base of typical laymen, but would nevertheless be a routine undertaking for those of ordinary skill in the relevant fields.

Figure 1:
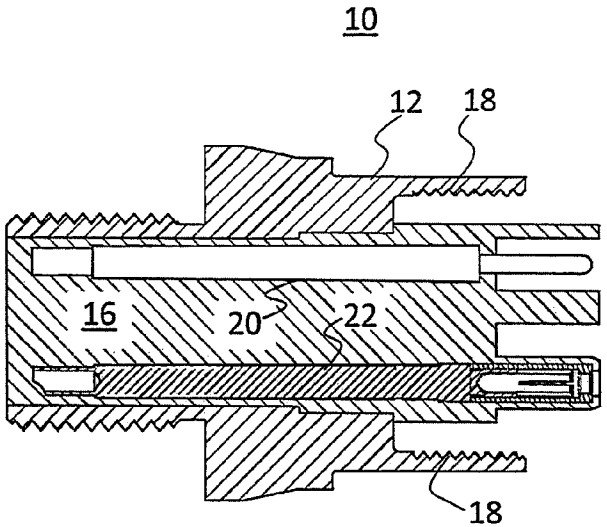
Figure 1 (Prior Art)
FIG. 1 is a side cross-sectional view of a prior art pin-and-socket type electrical connector.
Figure 2:
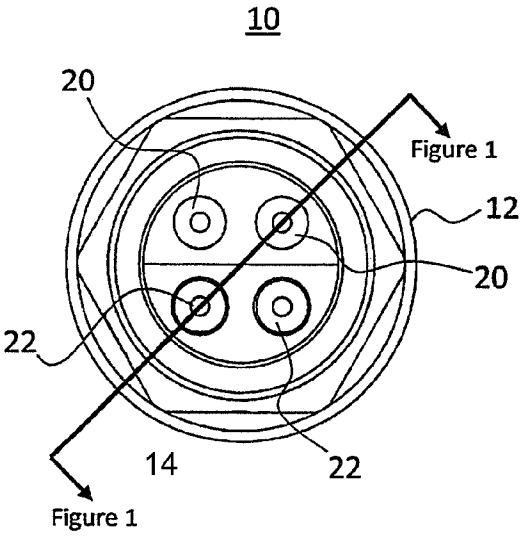
Figure 2 (Prior Art)
FIG. 2 is a distal end view of the electrical connector from FIG. 1.
Figure 3:
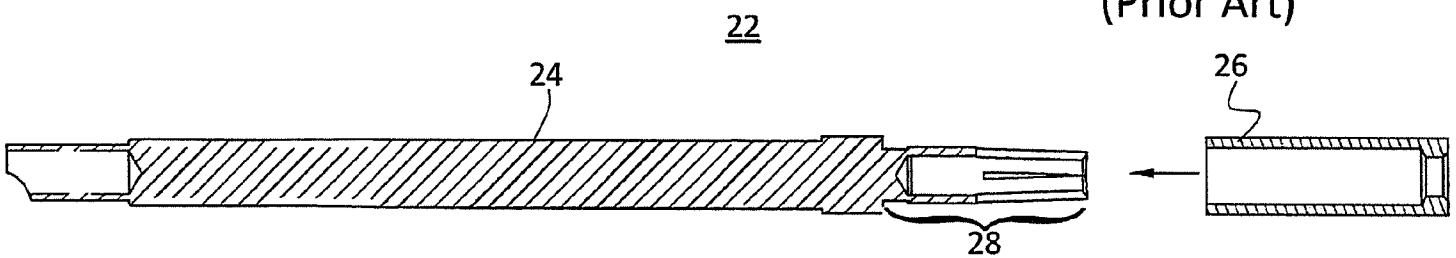
Figure 3 (Prior Art)
FIG. 3 is a side cross-sectional view of a socket assembly in the electrical connector from FIG. 1.

Referring to FIGS. 1, 2, and 3, there are provided various views of an electrical connector 10 (or portions thereof) in accordance with prior art designs. FIG. 1 is a side, cross-sectional view of connector 10, and FIG. 2 is a distal end view of connector 10.

Connector 10 comprises an outer body, which in the disclosed embodiment includes mating first and second body portions 12 and 14 defining an interior space 16. In the disclosed embodiment, first and second body portions are joined by a threaded connection 18. Supported within the outer body are at least one pin assembly 20 and at least one socket assembly 22. In the disclosed embodiment, connector 10 has two pin assemblies 20 and two socket assemblies 22. (The present disclosure is primarily directed to a connector having at least one socket assembly, and the inclusion of additional socket assemblies and/or of one or more pin assemblies is of no particular consequence to the present disclosure.) The interior space 16 is preferably potted or filled with an insulative material, such as a plastic, which serves to secure and support the pin and socket assemblies 20, 22, as would be familiar to persons of ordinary skill in the art.

FIG. 3 is an exploded, side cross-sectional view of a prior art socket assembly 22. As shown in FIG. 3, socket assembly 22 comprises an elongate socket body core 24 and a socket hood 26 adapted to surround a distal section 28 of socket body core 24. In typical implementations, the socket core 24 is machined out of a beryllium/copper alloy, and the hood 26 is machined out of brass, although these compositions are not regarded as an essential element of the invention.

Figure 6:
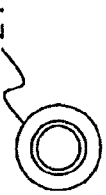
Figure 6 (Prior Art)
FIG. 6 is a distal end view of the socket assembly from FIG. 3.
Figure 9:
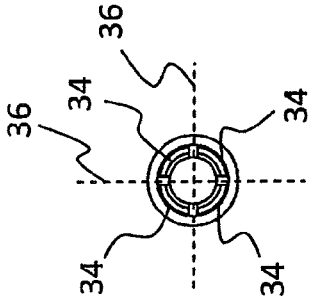
Figure 9 (Prior Art)
FIG. 9 is a distal end view of a socket body core in the socket assembly from FIG. 3.
Figure 5:
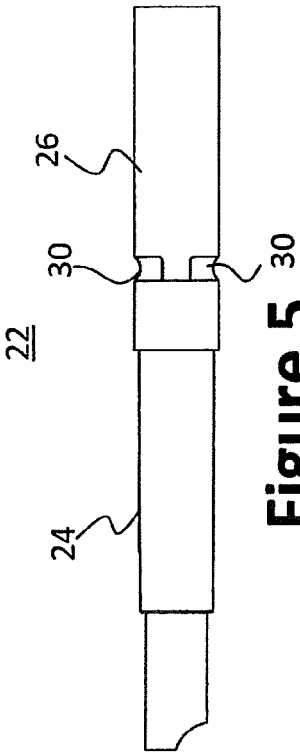
Figure 5 (Prior Art)
FIG. 5 is a side view of the socket assembly from FIG. 3.
Figure 8:
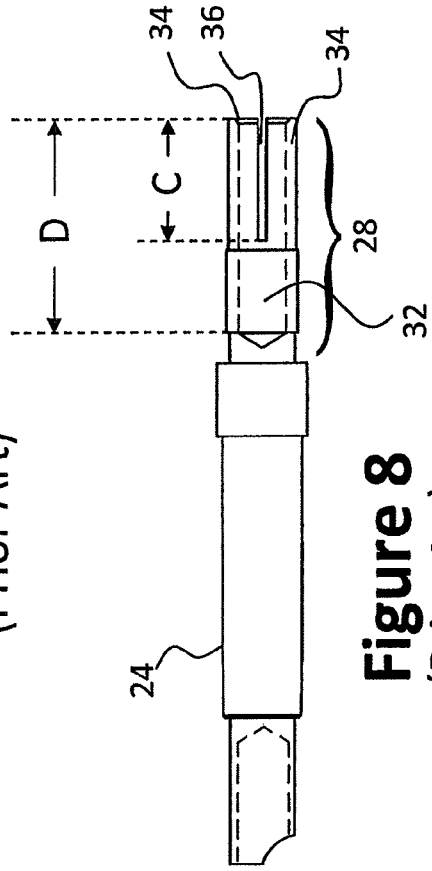
Figure 8 (Prior Art)
FIG. 8 is a side view of a socket body core in the socket assembly from FIG. 3.
Figure 4:
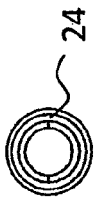
Figure 4 (Prior Art)
FIG. 4 is a proximal end view of the socket assembly from FIG. 3.
Figure 7:
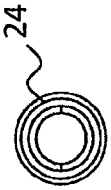
Figure 7 (Prior Art)
FIG. 7 is a proximal end view of a socket body core in the socket assembly from FIG. 3.

FIG. 4 is a proximal end view, FIG. 5 is a side view, and FIG. 6 is a distal end view, of socket assembly 22 including socket core 24 and hood 26. FIG. 7 is a proximal end view, FIG. 8 is a side view, and FIG. 9 is a distal end view of socket core 24 from FIG. 1. FIG. 5 shows that hood 26 is retained over the distal end portion 28 of core 24 by crimping, as indicated at reference numerals 30.

From FIGS. 8 and 9, it can be observed that the distal end portion 28 of socket core 24 is substantially cylindrical, with a cylindrical bore 32 being formed therein to achieve a substantially hollow cylindrical configuration of section 28. In this prior art embodiment, bore 32 has a depth D. A plurality of arcuate leaf contacts 34 are formed from the distal portion of section 28. These leaf contacts are formed by making two transverse, radial cuts represented by the dashed lines designated with reference numerals 36 in FIG. 9. The two cuts 36 are made to a length C as shown in FIG. 8, and being perpendicular to one another, the two cuts 36 result in four equal sized arcuate leaf contacts 34. In the disclosed prior art embodiment of FIGS. 8 and 9, the length C of cuts 36 is greater than one-half of the depth D of bore 32, i.e., $C>D/2$.

Figure 10:
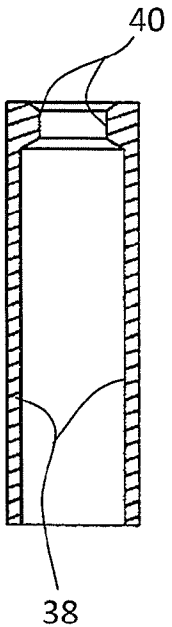
FIG. 10 is a side cross-sectional view of a socket hood in the socket assembly from FIG. 3.
Figure 12:
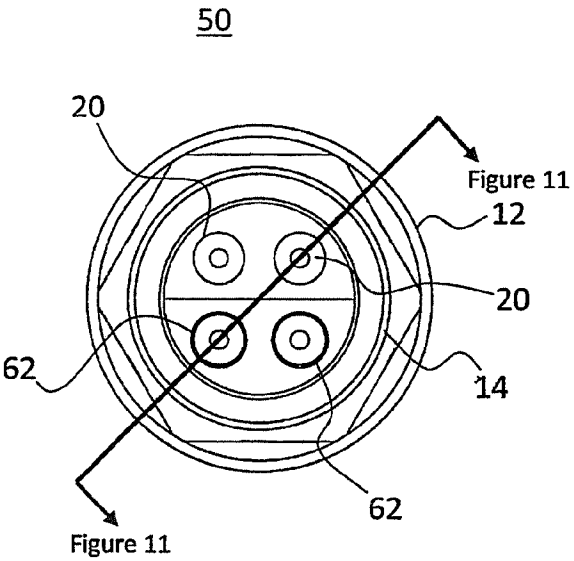
FIG. 12 is a distal end view of the electrical connector from FIG. 11.

A side cross-sectional view of hood 26 is shown in FIG. 10. In this disclosed prior art embodiment, hood is a hollow cylinder with a uniform cylindrical inner sidewall 38 and an inward flange 40 at its distal end.

As noted above, conventional pin-and-socket connectors such as that described with reference to FIGS. 1-10 above have been shown experimentally and in practice to be susceptible to interruptions in electrical continuity when utilized in environments in which they are repeatedly subjected to vibration and shock. Such interruptions occur when the leaf contacts 34 fail to make secure electrical contact with the pin contact inserted into the socket.

Accordingly, and referring now to FIG. 11 through 20 and 20*a*, the present disclosure is directed to a pin-and-socket type connector 50 that is resistant to vibration and shock forces and thereby maintains uninterrupted electrical continuity even when repeatedly subjected to vibration and shock forces.

Figure 11:
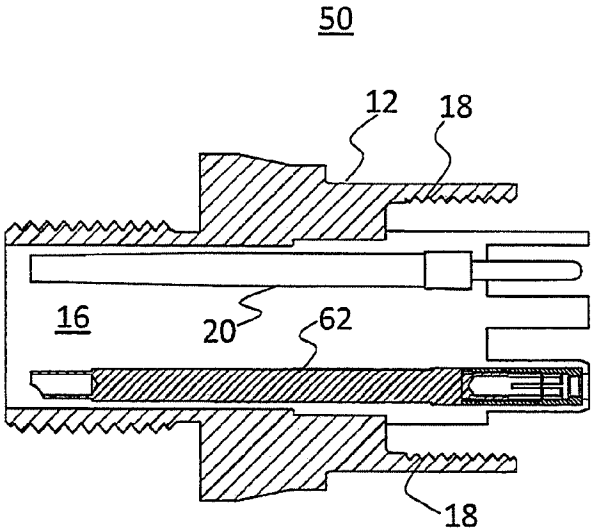
FIG. 11 is a side cross-sectional view of an electrical connector in accordance with one embodiment of the invention.

FIG. 11 is a side cross-sectional view of a shock-resistant electrical connector 50 in accordance with one embodiment of the invention. It is to be understood that various features and components of electrical connector 50 are essentially identical to features and components of the prior art connector of FIGS. 1 through 10, and these identical features and components retain identical reference numerals in FIGS. 11 through 20.

As shown in FIG. 11, connector 50 comprises an outer body, which in the disclosed embodiment includes mating first and second body portions 12 and 14 defining an interior space 16. In the disclosed embodiment, first and second body portions are joined by a threaded connection 18. Supported within the outer body are at least one pin assembly 20 and at least one socket assembly 62. In the disclosed embodiment, connector 50 has two pin assemblies 20 and two socket assemblies 62. (The present disclosure is primarily directed to a connector having at least one socket assembly, and the inclusion of additional socket assemblies and/or of one or more pin assemblies is of no particular consequence to the present disclosure.) The interior space 16 is preferably potted or filled with an insulative material, such as a plastic, which serves to secure and support the pin and socket assemblies 20, 62, as would be familiar to persons of ordinary skill in the art.

Figure 13:
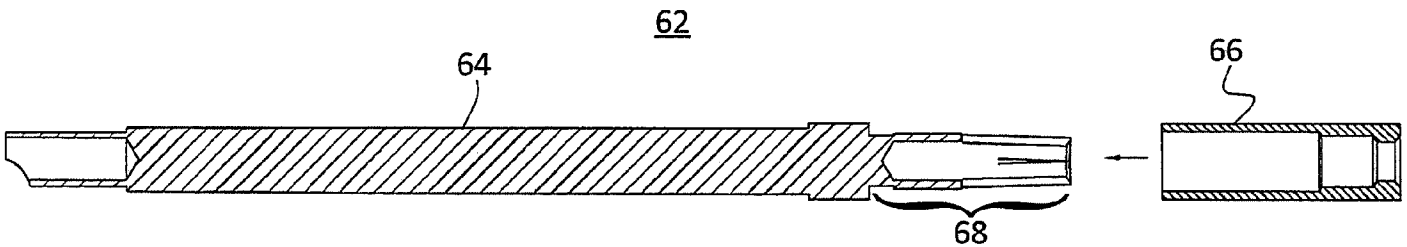
FIG. 13 is a side cross-sectional view of a socket assembly in the electrical connector from FIG. 11.

FIG. 13 is an exploded, side cross-sectional view of a new socket assembly 62. As shown in FIG. 13, socket assembly 62 comprises an elongate socket body core 64 and a socket hood 66 adapted to surround a distal section 68 of socket body core 64.

Figure 16:
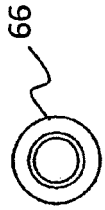
FIG. 16 is a distal end view of the socket assembly from FIG. 13.
Figure 15:
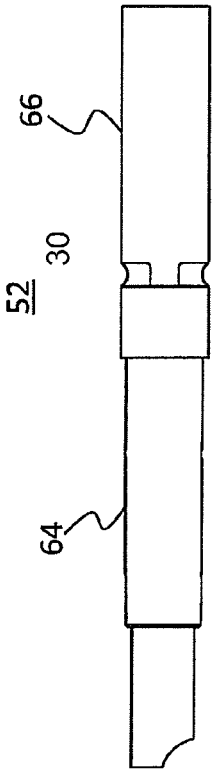
FIG. 15 is a side view of the socket assembly from FIG. 13.
Figure 14:
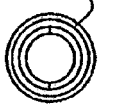
FIG. 14 is a proximal end view of the socket assembly from FIG. 13.
Figure 19:
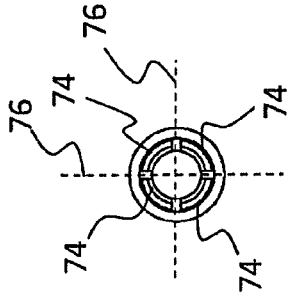
FIG. 19 is a distal end view of a socket body core in the socket assembly from FIG. 13.
Figure 18:
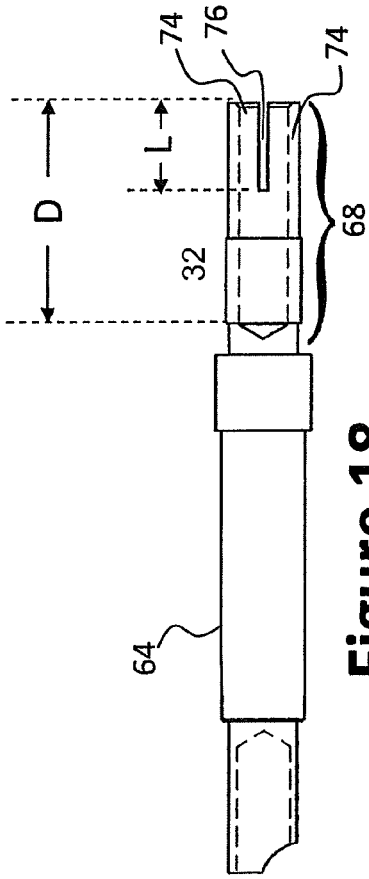
FIG. 18 is a side view of a socket body core in the socket assembly from FIG. 13.
Figure 17:
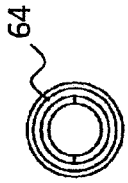
FIG. 17 is a proximal end view of a socket body core in the socket assembly from FIG. 13.

FIG. 14 is a proximal end view, FIG. 15 is a side view, and FIG. 16 is a distal end view, of socket assembly 62 including socket core 64 and hood 66. FIG. 17 is a proximal end view, FIG. 18 is a side view, and FIG. 19 is a distal end view of socket body core 64 from FIG. 11. FIG. 15 shows that hood 66 is retained over the distal end portion 68 of core 64 by crimping, as indicated at reference numerals 30.

From FIGS. 18 and 19, it can be observed that the distal end portion 68 of socket core 64 is substantially cylindrical, with a cylindrical bore 32 being formed therein to achieve a substantially hollow cylindrical configuration of section 68. In this embodiment, bore 32 has a depth D. A plurality of arcuate leaf contacts 74 are formed from the distal portion of section 68. These leaf contacts 74 are formed by making two transverse, radial cuts represented by the dashed lines designated with reference numerals 76 in FIG. 9. The two cuts 76 are made to a length L as shown in FIG. 8, and being perpendicular to one another, the two cuts 76 result in four equal sized arcuate leaf contacts 74. In one embodiment, the length L of cuts 76 is less than one-half of the depth D of bore 32, i.e., $L<D/2$.

Figure 20A:
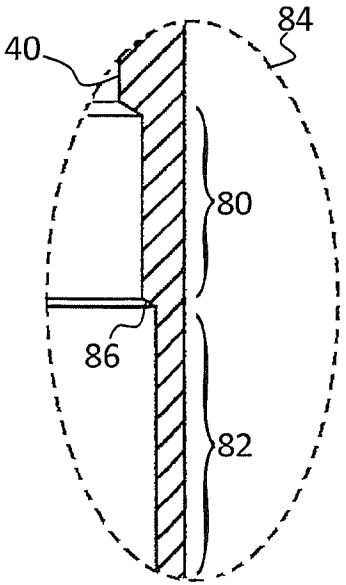
FIG. 20*a* is an enlarged cross-sectional view of a portion of the socket hood from FIG. 20.
Figure 20:
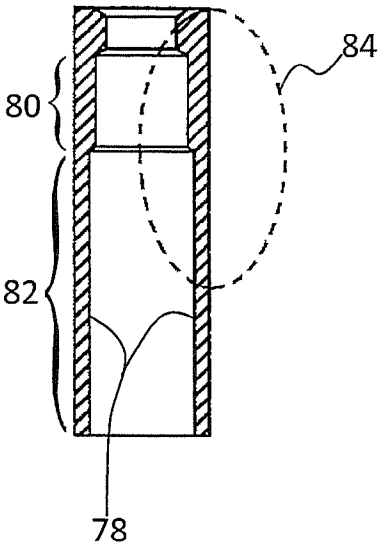
FIG. 20 is a side cross-sectional view of a socket hood in the socket assembly from FIG. 13.

A side cross-sectional view of hood 66 is shown in FIG. 20. In this disclosed embodiment of the invention, hood is a hollow cylinder with a stepped, non-uniform cylindrical inner sidewall 78 and an inward flange 40 at its distal end. In particular, the inner sidewall 78 of hood 66 has structure in the form of a distal portion 80 with a reduced inner diameter relative to a proximal portion 82. A portion of hood 66 within dashed line 84 in FIG. 20 is shown enlarged in FIG. 20*a*. From FIG. 20*a*, there can be observed a step-wise transition 86 between the sidewall of section 82 of hood 66 and the reduced-diameter sidewall of section 80 of hood 66. (Although a step-wise transition between sections 80 and 82 is shown in FIGS. 20 and 20*a*, it is contemplated that the transition to a reduced diameter inner sidewall of hood 66 can be more gradual in an alternative embodiment.) This structure functions to limit the radial deflection of leaf contacts 74 both during insertion of a pin contact therein and during shock events to which the connector 50 is subjected during use. Limiting outward deflection of the leaf contacts in this way advantageously prevents the contacts from yielding to the extent that permanent deformation occurs. In one embodiment, this structure causes slight inward deflection of leaf contacts 74 when no pin contact is inserted.

The design of the connector 50 in accordance with the presently disclosed embodiment of the invention has been experimentally shown to have a substantial and unexpectedly positive impact on the reliability of the connector when subjected to repeated shock forces.

In particular, shock tests on prior art connectors (such as that shown in FIG. 1) and connectors in accordance with embodiments of the present invention (such as that shown in FIG. 11) have been performed. The test apparatus consisted of a motorized weighted pendulum striking a stainless steel housing containing the units under test. A current (e.g., 12 amps) was run through the connector under test at each strike, and the voltage across the connectors was monitored. Connectors were tested for insertion and retention forces both before and after 70,000 cycle runs on the test stand.

In qualitative observation, each socket assembly was found to be looser (i.e., less retention force) post-test. However, each socket in accordance with the tested embodiments of the invention had positive contact with the inserted pin throughout the entire stroke of insertion. Once inserted, each pin had a small amount of "wiggle," however the pin was firmly supported and held. This is in surprising contrast to the connectors in accordance with the prior art, which often could no longer retain a pin after the testing.

Figure 21A:
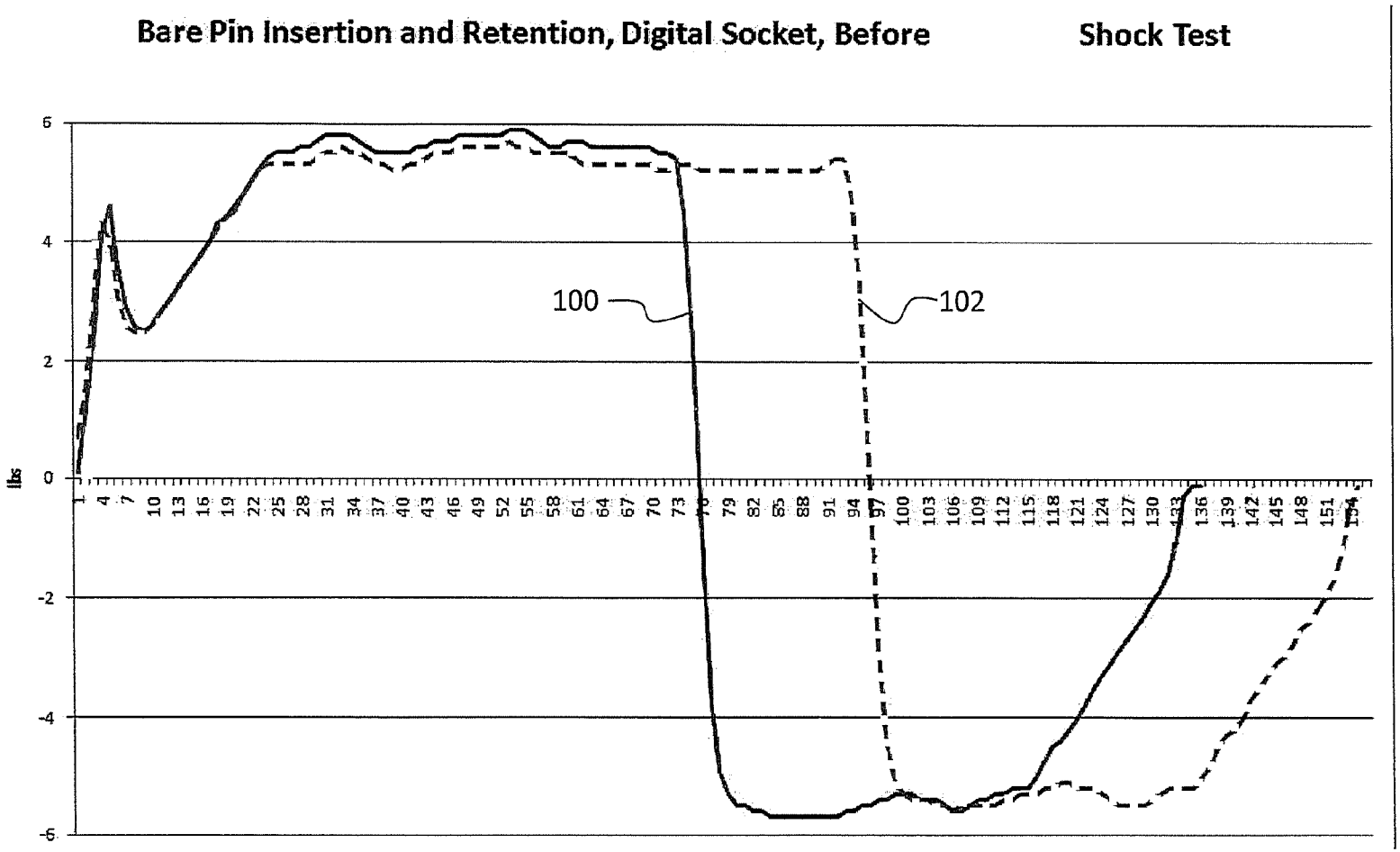
FIG. 21*a* shows plots of insertion and retention force versus time for the electrical connector of FIG. 11, before being subjected to shock testing.
Figure 21B:
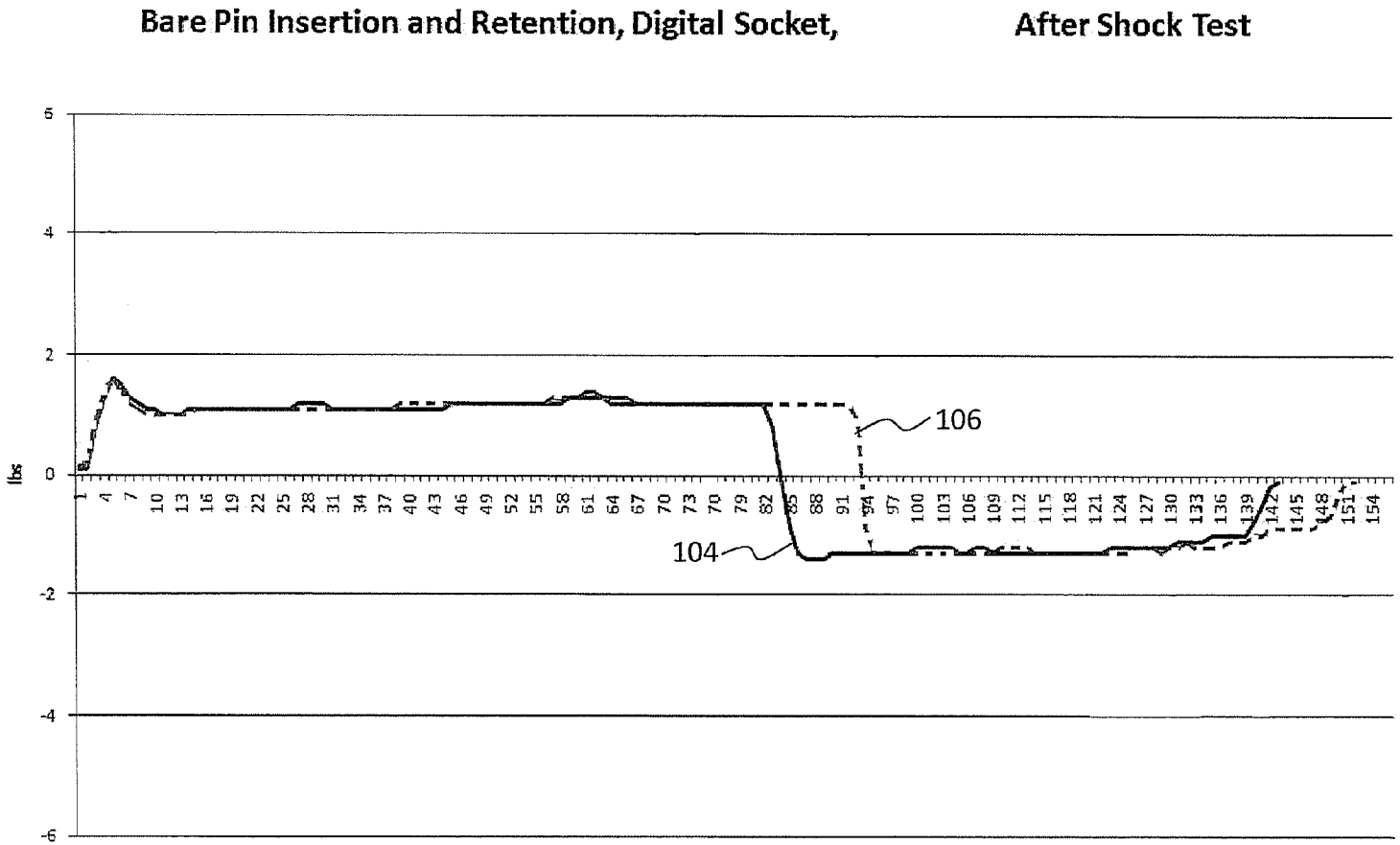
FIG. 21*b* shows plots of insertion and retention force versus time for the electrical connector of FIG. 11, after being subjected to shock testing.

FIG. 21*a* shows plots of insertion force (reference numeral 100) and retention force (reference numeral 102) for connector 50 (FIG. 11) in accordance with one embodiment of the invention prior to subjecting the connector 50 to the shock test as described above. FIG. 21*b* shows plots of insertion force (reference numeral 104) and retention force (reference numeral 106) for connector 50 after undergoing the shock test.

Figure 21C:
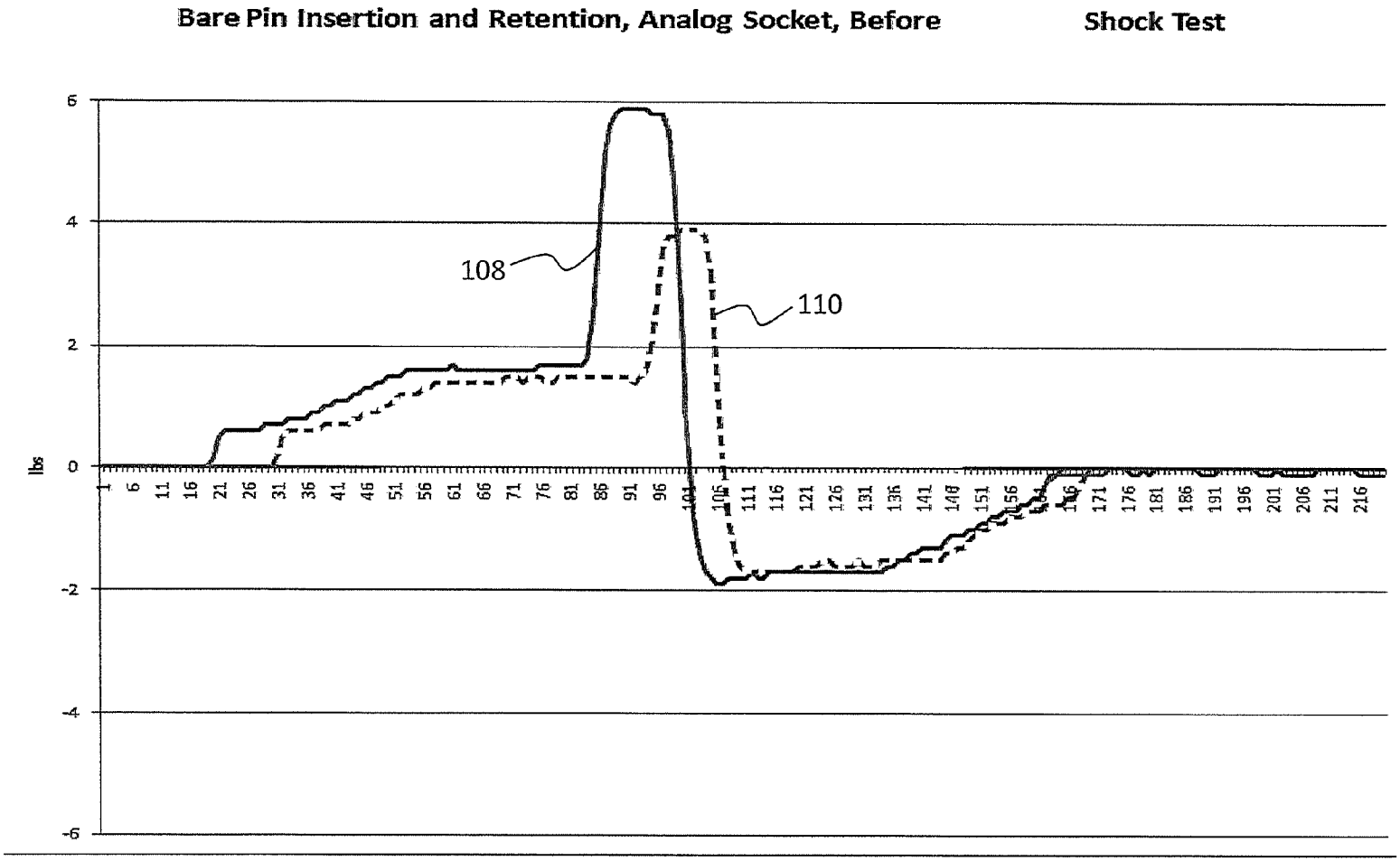
FIG. 21*c* shows plots of insertion and retention force versus time for a prior art electrical connector before being subjected to shock testing.
Figure 21D:
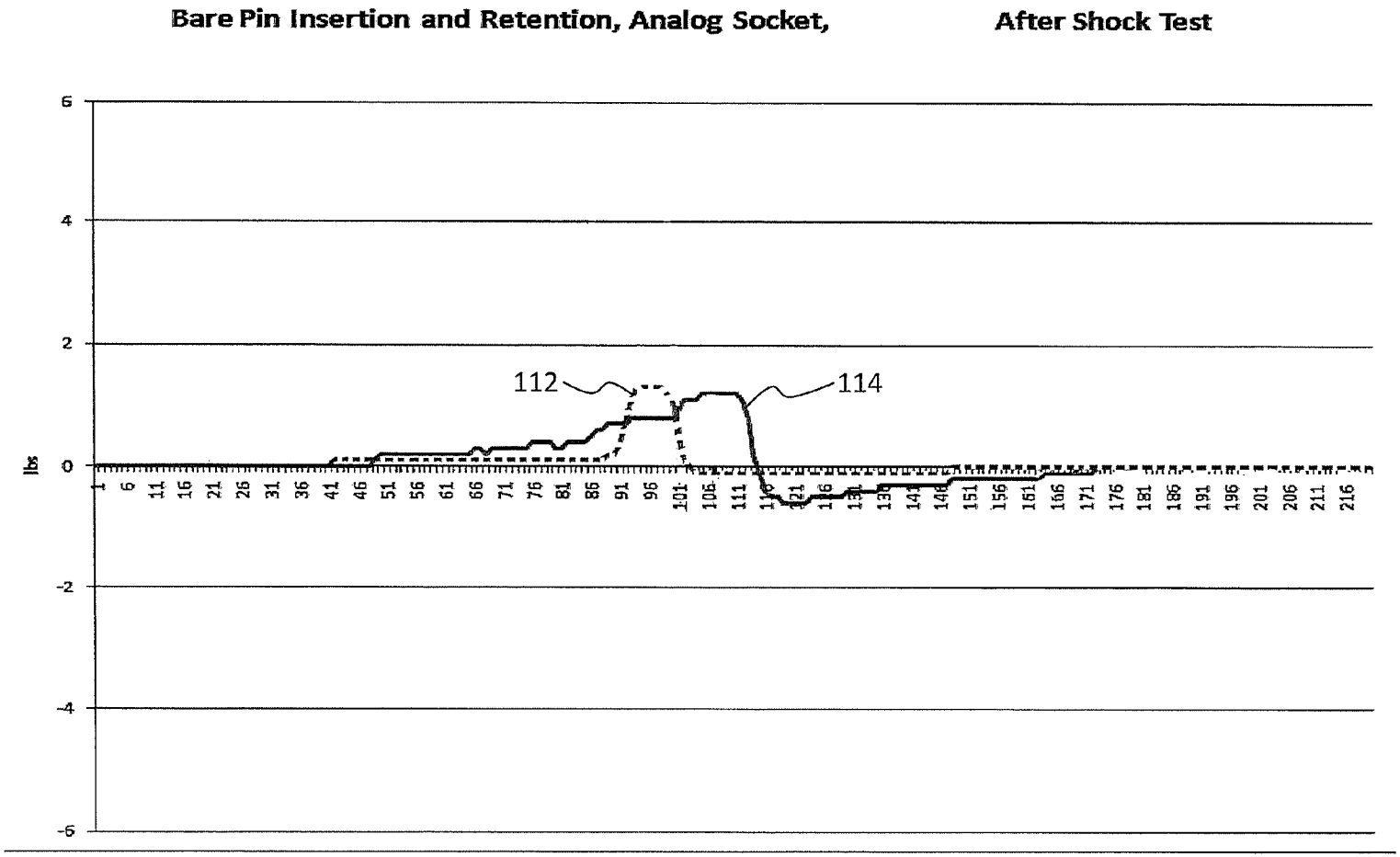
FIG. 21*d* shows plots of insertion and retention force versus time for a prior art electrical connector after being subjected to shock testing.

On the other hand, FIG. 21*c* shows plots of insertion force (reference numeral 108) and retention force (reference numeral 110) for connector 10 (FIG. 1) in accordance with prior art designs prior to undergoing shock testing, and FIG. 21*d* shows plots of insertion force (reference numeral 112) and retention force (reference numeral 114) for connector 10 after undergoing shock testing as described above.

Those of ordinary skill in the art will note from FIGS. 21*a* and 21*b* the flatter force profiles of connector 50 in accordance with one embodiment of the invention compared with those of the prior art connector 10. In the case of FIGS. 21*a* and 21*b*, a constant force is applied to the pin contact throughout the stroke, whereas in the case of FIGS. 21*c* and 21*d*, a more concentrated, sudden force is applied to the pin contact.

From comparing FIGS. 21*a* and 21*b*, it can be observed that the force profile characteristics were retained even after the shock testing, although the overall magnitude of the force decreased. Comparing FIGS. 21*c* and 21*d*, on the other hand, it can be seen that the prior art design saw not only diminished force after shock testing, but also moments in the pin stroke where nearly no force was applied. Those of ordinary skill in the art would conclude from this data that the sockets in accordance with the tested embodiments of the present invention performed substantially more reliably than those of the prior art design. The insertion and retention forces for socket 50 in accordance with one embodiment of the invention, after shock testing (FIG. 21*b*), are an order of magnitude higher than those for the prior art socket 10 (FIG. 21*d*). Typical insertion and retention forces for the prior art design (FIGS. 21*c* and 21*d*) are measured in tenths of pounds, while insertion and retention forces for the socket 50 in accordance with the tested embodiments of the present invention held steady at greater than one pound for the entire stroke.

Figure 22:
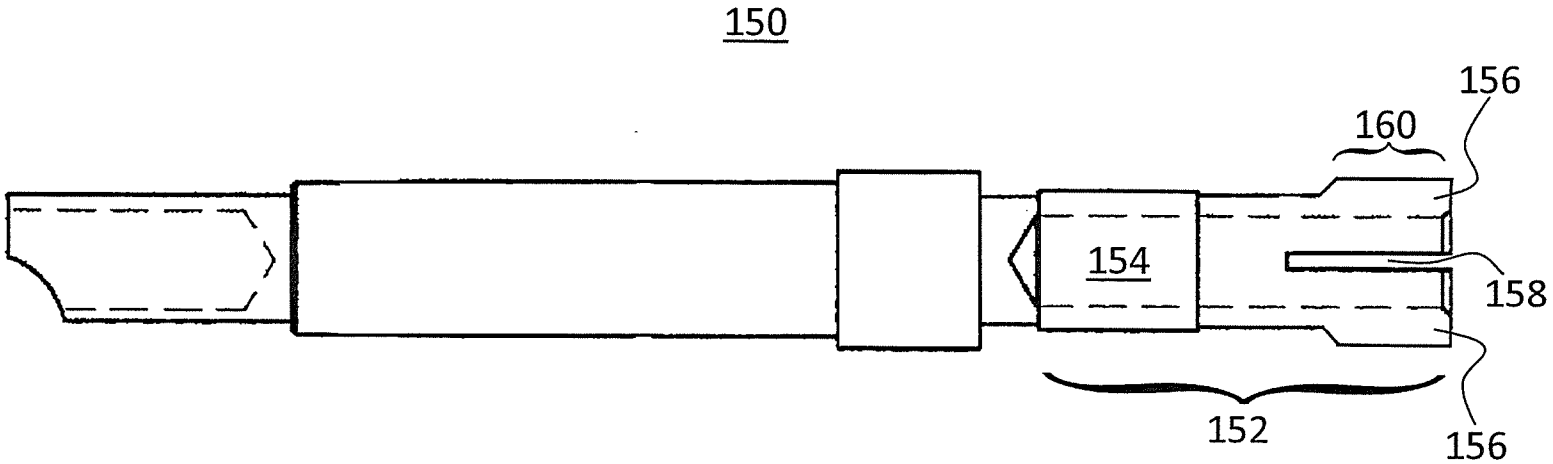
FIG. 22 is a side view of a socket body core in accordance with an alternative embodiment of the invention.

An alternative embodiment of the invention has been considered, in which structure for limiting the deflection of the leaf contacts of a connector socket is associated with the socket itself instead of with the hood surrounding the socket's leaf contacts. Referring to FIG. 22, there is shown a socket core 150 in accordance with an alternative embodiment of the invention. From FIG. 22, it can be observed that the distal end portion 152 of socket core 150 is substantially cylindrical, with a cylindrical bore 154 being formed therein to achieve a substantially hollow cylindrical configuration of section 152. A plurality of arcuate leaf contacts 156 are formed from the distal portion of section 152. These leaf contacts 156 are formed by making two transverse, radial cuts 158. The two cuts 158, being perpendicular to one another, result in four equal sized arcuate leaf contacts 156.

In accordance with this alternative embodiment of the invention, a distal portion of each leaf contact 156 is provided with an outwardly flanged structure 160 which increases the outer diameter of socket 150 at the distal end of section 152. Socket 150 can be utilized in conjunction with a conventional hood, such as hood 26 of FIGS. 3 and 10*a*. The flanged structure 160 cooperates with the hood to limit the extent of radial deflection of said leaf contacts when the connector is subjected to shock forces and the like. This prevents the leaf contacts from yielding to an extent which causes permanent deformation of the leaf contacts. It is to be noted that flange structure 160 is not necessarily shown to scale in FIG. 22, and persons of ordinary skill in the art having the benefit of the present disclosure will recognize that the particular shape and dimensions of flange structure 160 will vary from implementation to implementation in order to achieve the functionality described herein.

From the foregoing disclosure, it should be apparent that an electrical connector that has features which render it substantially more resistant to shock than prior art designs has been disclosed. Although specific embodiments of the invention have been described and/or suggested herein, it is to be understood that the present disclosure is intended to teach, suggest, and illustrate various features and aspects of the invention, but is not intended to be limiting with respect to the scope of the invention, as defined exclusively in and by the claims, which follow.

Indeed, it is contemplated and to be explicitly understood that various substitutions, alterations, and/or modifications, including but not limited to any such implementation variants and options as may have been specifically noted or suggested herein, including inclusion of technological enhancements to any particular component discovered or developed subsequent to the date of this disclosure, may be made to the disclosed embodiment of the invention without necessarily departing from the technical and legal scope of the invention as defined in the following claims.

What is claimed is:

1. An electrical connector, comprising:

a connector body supporting a socket assembly, the socket assembly adapted to receive a pin contact therein;

the socket assembly comprising:

a socket core having a distal portion that includes:

a base portion; and a plurality of arcuate leaf contacts, each of the arcuate leaf contacts having a fixed length from the base portion to a distal end of the socket core; and a socket hood having an inner surface surrounding the distal portion of the socket core, the inner surface comprising:

a first cylindrical section having a first inner diameter; and a second cylindrical section having a second inner diameter about the arcuate leaf contacts, the second inner diameter abutting the arcuate leaf contacts when no pin contact resides therein, being smaller than the first inner diameter, and defining a range of outward radial deflection of the arcuate leaf contacts when the socket assembly is subjected to shock forces.

2. The electrical connector of claim 1, wherein the inner surface has a stepped cylindrical inner diameter and the second cylindrical section surrounds the distal end of the socket core.

3. The electrical connector of claim 1, wherein the connector body further supports at least one pin contact assembly adjacent to the socket assembly.

4. The electrical connector of claim 1, wherein the socket core is made of a beryllium/copper alloy.

5. The electrical connector of claim 1, wherein the distal portion of the socket core includes four leaf contacts.

6. The electrical connector of claim 1, wherein the distal portion of the socket core defines a uniform outer diameter along the length of the leaf contacts.

7. An electrical connector, comprising:

a connector body supporting a socket assembly, the socket assembly adapted to receive a pin contact therein; and the socket assembly comprising:

a socket core that includes:

a base portion; and a plurality of arcuate leaf contacts, each of the arcuate leaf contacts having a fixed length from the base portion to a distal end of the socket core; and a socket hood having a cylindrical inner surface surrounding the leaf contacts;

the leaf contacts each have an outwardly flanged distal portion, the outwardly flanged distal portions define an outer diameter that cooperates with the cylindrical inner surface of the socket hood to define a range of outward radial deflection of the leaf contacts when the socket assembly is subjected to shock forces.

8. The electrical connector of claim 7, wherein the cylindrical inner surface has a uniform cylindrical inner diameter along a length of the leaf contacts.

9. The electrical connector of claim 7, wherein the connector body further supports at least one pin contact assembly adjacent to the socket assembly.

10. The electrical connector of claim 7, wherein the socket core is made of a beryllium/copper alloy.

11. The electrical connector of claim 7, wherein the socket core has four leaf contacts.

12. The electrical connector of claim 7, wherein the leaf contacts have a stepped outer diameter.

13. A method of modifying an electrical connector that includes a socket core adapted to receive a pin contact, the method comprising:

accessing arcuate leaf contacts at a distal portion of the socket core, each of the arcuate leaf contacts having a fixed length from a base portion of the socket core to a distal end of the socket core; and providing a socket hood surrounding the distal portion of the socket core, the socket hood having an inner surface surrounding the distal portion of the socket core, the inner surface including:

a first cylindrical section having a first inner diameter; and a second cylindrical section having a second inner diameter about the arcuate leaf contacts, the second inner diameter abutting the arcuate leaf contacts when no pin contact resides therein, being smaller than the first inner diameter, and defining a range of outward radial deflection of the arcuate leaf contacts when the electrical connector is subjected to shock forces.

14. The method of claim 13, wherein the inner surface has a stepped cylindrical inner diameter and the second cylindrical section surrounds the distal end of the socket core.

15. The method of claim 13, wherein the electrical connector includes a pin contact assembly and a socket assembly, and the socket assembly includes the socket core.

16. The method of claim 13, wherein the socket core is made of a beryllium/copper alloy.

17. The method of claim 13, wherein the distal portion of the socket core includes four leaf contacts.

18. The method of claim 13, wherein the distal portion of the socket core defines a uniform outer diameter along the length of the leaf contacts.

19. The method of claim 13, wherein providing the socket hood comprises inserting the socket hood into a socket assembly that includes the socket core.

* * * * *